United States Patent [19]

Di Maio et al.

[11] 4,037,448

[45] July 26, 1977

[54] METAL LEVELER TOOL

[75] Inventors: Anthony E. Di Maio, Georgetown; Alfred E. Bresnahan, Wenham; Joseph G. Todisco, Georgetown, all of Mass.

[73] Assignee: Marson Corporation, Chelsea, Mass.

[21] Appl. No.: 635,065

[22] Filed: Nov. 25, 1975

[51] Int. Cl.[2] ..... B21D 1/12

[52] U.S. Cl. ..... 72/114; 72/391; 72/705

[58] Field of Search ..... 72/705, 391, 114, 389

[56] References Cited

U.S. PATENT DOCUMENTS

| | | | |
|---|---|---|---|
| 2,749,795 | 6/1956 | Boykin | 72/705 |
| 2,949,144 | 8/1960 | Dredske | 72/389 |
| 3,187,538 | 6/1965 | Painter | 72/114 |
| 3,635,072 | 1/1972 | Steinmann | 72/705 |
| 3,842,649 | 10/1974 | Di Maio | 72/391 |
| 3,977,230 | 8/1976 | Jones | 72/461 |

*Primary Examiner*—C.W. Lanham
*Assistant Examiner*—Gene P. Crosby
*Attorney, Agent, or Firm*—Pennie & Edmonds

[57] ABSTRACT

A metal leveler tool includes a body having a handle portion and a housing. A chuck is received by the body through the housing for linear movement between two limit positions. A movable handle is coupled to the chuck and mounted by the body for pivotal movement about a fulcrum. A machine screw is supported by the chuck to be threadedly received through a workpiece within an area of a dent upon movement of the chuck to one limit position followed by pivotal movement of the movable handle. The housing of the body is supported by an anvil which is supported by the workpiece over the dent. Pivotal movement of the movable handle in the other direction followed by reverse movement of the chuck to the second limit position acts to draw the dented area of the workpiece toward the anvil.

10 Claims, 10 Drawing Figures

FIG. 1.
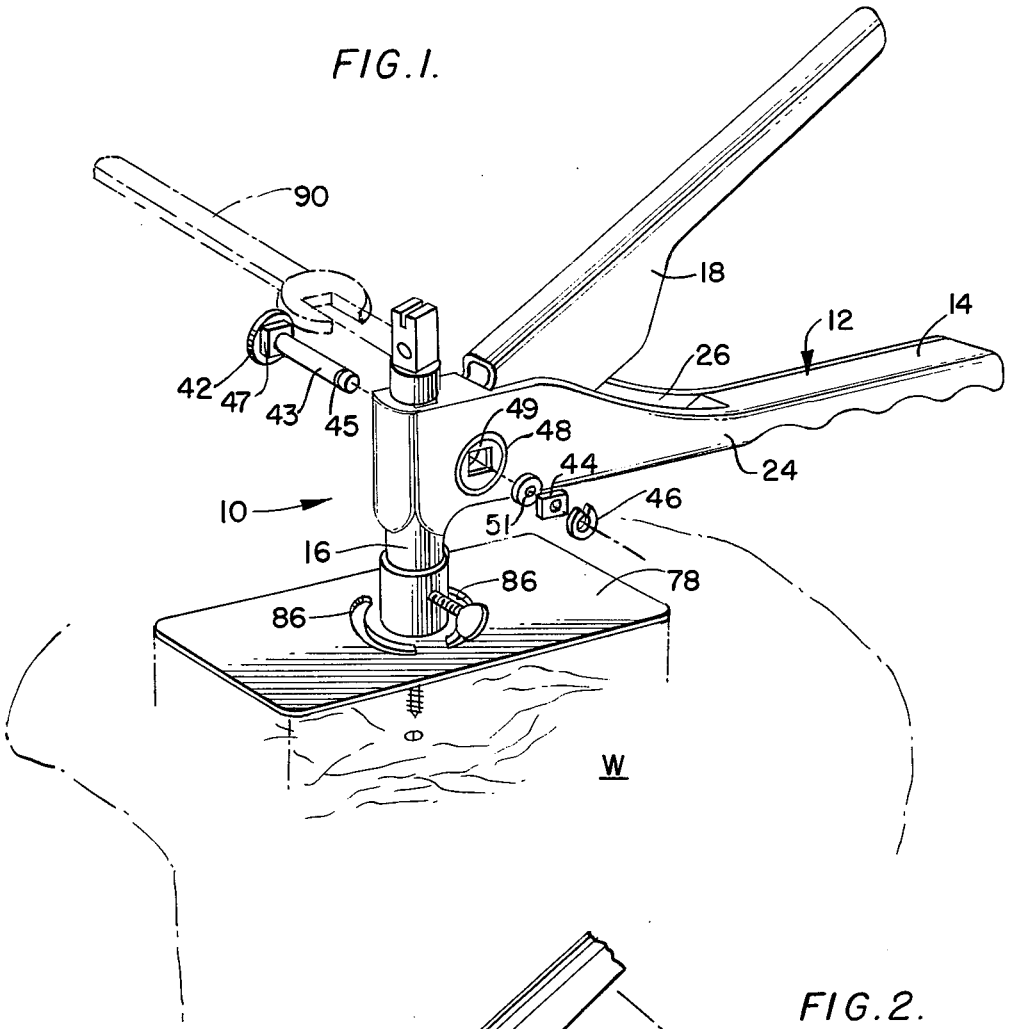
FIG. 2.
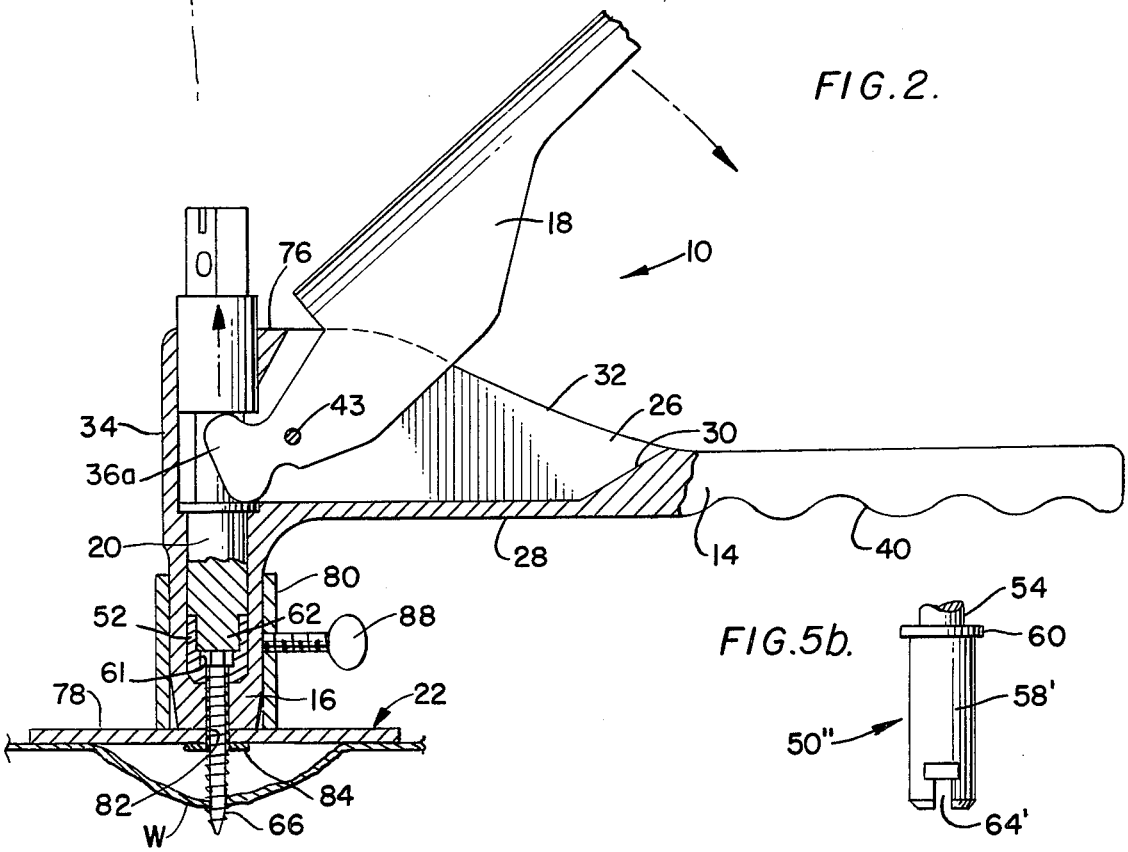
FIG. 5b.

FIG. 3.
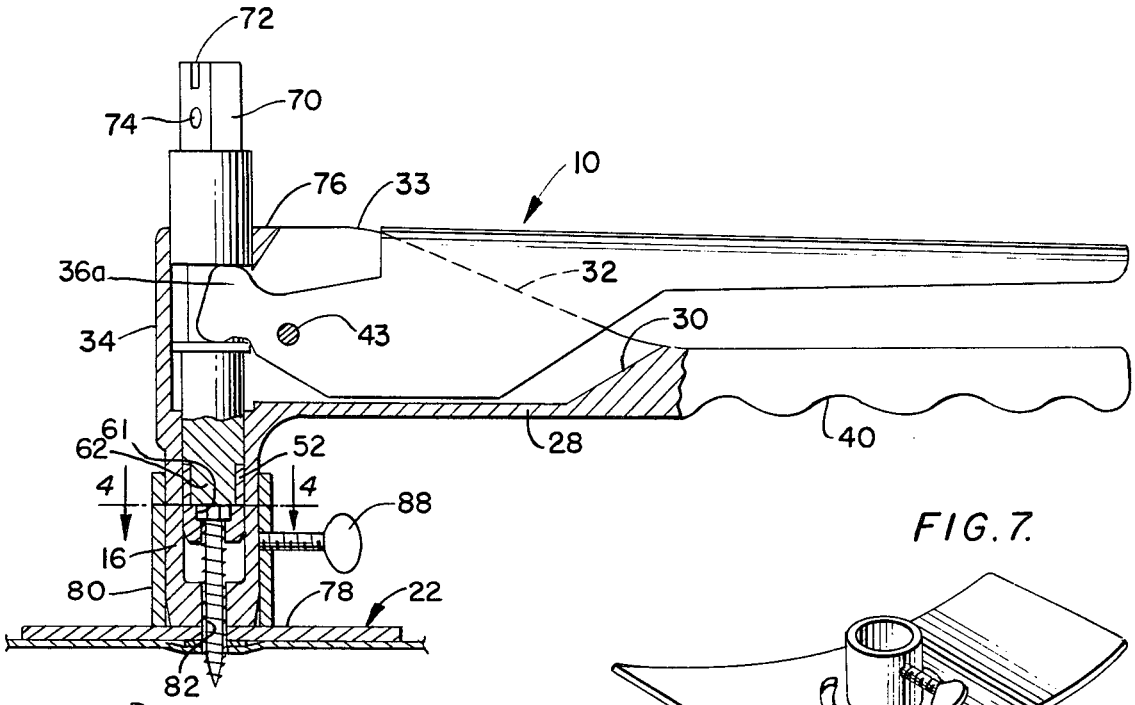
FIG. 7.
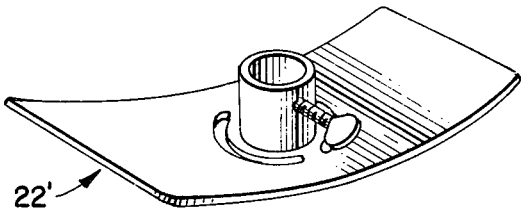
FIG. 5a.
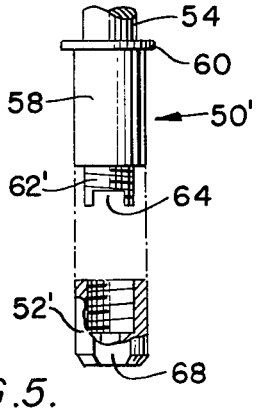
FIG. 8.
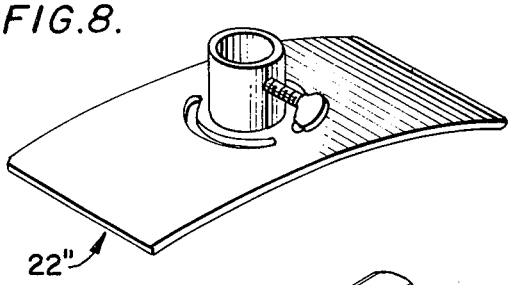
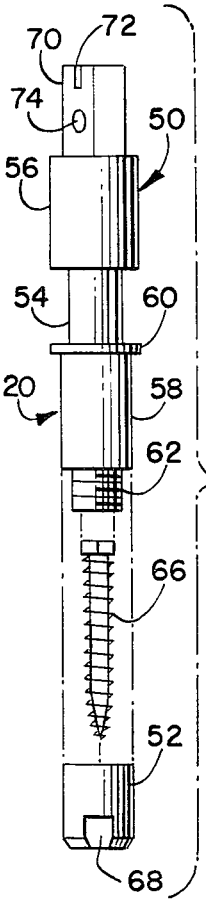
FIG. 5.
FIG. 6.
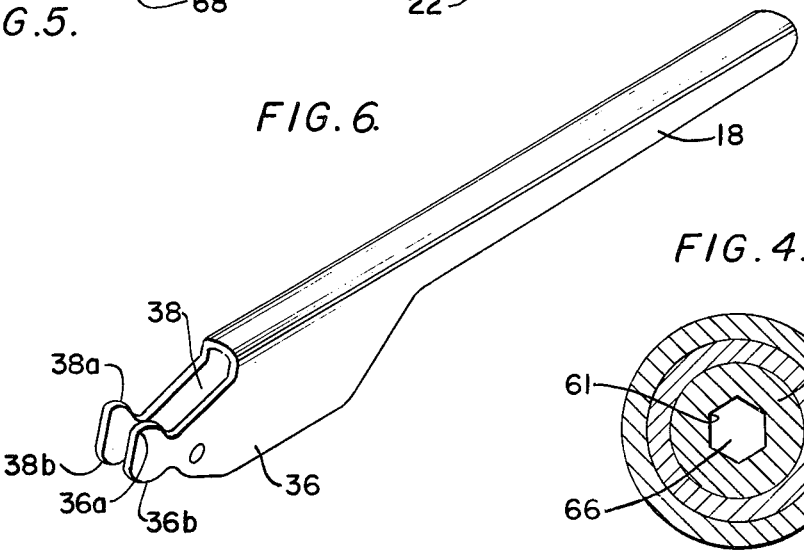
FIG. 4.
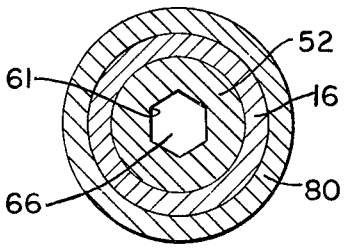

METAL LEVELER TOOL

BACKGROUND OF THE INVENTION

Apparatus capable of use in the removal of dents within areas of a workpiece such as the sheet metal of fenders, doors or other surfaces of an automotive vehicle which typically are not openly accessible for working are known in the prior art.

Typically, the prior art apparatus is formed by structure capable of application of the same working action to the area of a dent in a workpiece as has been provided by a hammer and hammering action when the area of the dent is accessible. To this end, the prior art apparatus is formed by a tool having an elongated shank carrying a screw such as a machine screw at one end and having a member movable along the shank between spaced stops near the screw and a handle end. The member preferably is weighted and spring loaded or otherwise may be accelerated from one stop to the other. The force of impact of the weighted member striking a stop has the effect of either incrementally depressing inwardly or pulling outwardly the area of the workpiece to which the tool is attached.

Tools of this type suffer from disadvantages, among possible other disadvantages, that the dent is removed through impact and, unless the worker is extremely skilled, the single or several impacts may result in movement of the dented or a portion of the dented area of the workpiece through and beyond the plane of the undented surface. Such action requires that the previously worked area be worked in the other direction, resulting possibly in a rupture of the sheet metal, particularly if the damage thereto was severe. Further, the impact action permits only a small area of the dent to be worked, increasing the amount of time and labor expended in the operation. Further still, repeated impact to the metal within the area of the dent may result in a buckling of surrounding areas, particularly within large flat sheet metal surfaces such as the top, hood, and trunk lid of the automotive vehicle.

BRIEF DESCRIPTION OF THE INVENTION

The present invention is in an apparatus which has particular application in the working of a dent within an area of a workpiece thereby to level the metal by the action of a steady force through leverage on a pair of relatively pivotal handles. The apparatus and the mode of operation to be described herein, unlike many of the prior art dent puller structures, assures that the metal within the area of the dent is drawn to a position which is smoothly continuous with or closely approaching the surface surrounding the area of the dent but not through the plane of the surface surrounding the dent.

The apparatus includes a body having a handle portion and a housing portion. A casing for carrying a machine screw which projects therefrom is received by and movable longitudinally as well as rotationally within the housing portion. A movable handle is coupled to the casing and pivotally mounted by the body for movement relative to the body handle. The housing is received and secured by a pressure plate which may be disposed over the dented area whereby the casing may be rotated for threaded advance of the machine screw through the sheet metal within the area of the dent. Advancement of the casing toward a first limit position results in the movable handle pivoting away from the body handle. The exertion of a steady force through the action of leverage on the handle causes the casing to return from the first limit position, which results in a drawing movement of the area of the sheet metal in the dent. The pressure plate provides means to permit constant observation of the area being worked and acts as a restraint against the area of the dent being drawn through the plane of the surface surrounding the dent.

The present apparatus may be used by unskilled operators with success, and enables through a steady and gradual pulling operation a greater area of a dent to be drawn than by prior art devices. This results in a reduction in the filler to be used prior to final finishing. This is significant in cost savings and, importantly, the less filler to be used, the less of a problem of "shrinkage" which may be experienced in hot climates. The steady pulling of the area of the dent obviates or at least substantially reduces the possibility of buckling of surrounding areas of the sheet metal and, because of the fact that a larger area of the dent may be removed with each operation, there is a significant reduction in the cost of labor.

Other advantages of the invention will manifest themselves as the disclosure continues.

DESCRIPTION OF THE DRAWINGS

FIG. 1 is a view in perspective of the apparatus of the present invention;

FIG. 2 is an elevational view partially in vertical section of the apparatus of FIG. 1;

FIG. 3 is a view similar to that of FIG. 2 yet illustrating a different orientation of certain operative components;

FIG. 4 is a horizontal section as seen along the line 4—4 in FIG. 3;

FIG. 5 is an elevational view of a pulling casing and both a machine screw and a lower case exploded therefrom;

FIGS. 5*a* and 5*b* are partial views of the lower portion of alternative pulling casings;

FIG. 6 is a perspective view of an upper handle; and

FIGS. 7 and 8 are perspective views of alternative pressure plates, one being outwardly convex, the other inwardly concave, respectively.

DESCRIPTION OF THE PREFERRED EMBODIMENT

The apparatus of the present invention identified generally by the numeral 10 in the figures is described below in terms of its adaptation as a metal leveler.

The apparatus comprises a body 12 having a handle 14 extending in one direction and a housing 16 extending from and in a direction substantially normal to the handle. An upper handle 18 is mounted on the body 12 and movable pivotably between a pair of limit positions (see FIGS. 2 and 3). A casing 20 (hereinafter referred to as a "chuck") is received within the housing, and movable under the control of the upper or movable handle. A pressure plate 22 (hereinafter referred to as an "anvil") is capable of being supported juxtaposed to a workpiece W to overlie a dent, such as the dent in FIG. 2, and, in turn, supports the housing 16 of body 12.

The body 12, more particularly, is formed to provide a pair of spaced apart side walls 24 and 26 which are parallel one to the other and extend upward from a bottom wall 28. The bottom wall at one end is upwardly inclined at 30 toward the upper surface of handle 14 which is a solid extension of the body and at the other end terminates at an opening to the housing 16 through which the chuck is received.

The side walls 24 and 26 along a portion of their upper surfaces are inclined as at 32. The incline is illustrated as generally arcuate in contour. The remaining portion of the upper surfaces as at 33 generally is parallel to the bottom wall 28. An end wall 34 joins the side walls 24 and 26 and together with the side walls and bottom wall 28 provides an open area within which the movable handle 18 is received.

The movable handle 18 substantially throughout its length is of U-shaped or channel outline and includes a bifurcated end defining a pair of spaced and extended arms 36 and 38 (see FIG. 6). Arm 36 at its termination is bulbous in outline to provide upper and lower rounded surfaces 36*a* and 36*b*, respectively. Arm 38 is similar and provides upper and lower rounded surfaces 38*a* and 38*b*, respectively.

The movable handle 18 is mounted on the body 12 in an orientation such that the opening of the channel is toward the handle 14. Thus, the base of the channel of movable handle 18 is disposed for receipt within the palm of the hand while the handle 14 in a closing operation may be gripped by the fingers of the user. To this end, the handle 14 provides a finger gripping surface within a length 40.

Both the side walls 24 and 26 of body 12 and the spaced arms 36 and 38 of handle 18 are apertured. A pin 42 includes a shank portion 43, the latter being received through the apertures thereby to provide a fulcrum mounting for handle movement, as described.

Once received, the fulcrum pin is fixed against axial movement out of the apertures. To this end, the fulcrum pin may be formed with a flattened head 42 at one end to bear against the outer surface of the side wall 26 adjacent the aperture opening. The shank portion of the fulcrum pin within the region of the end that extends from the side wall 24 is formed with an annular cutout 45. A snap ring 46 or similar retaining means may be received within the cutout, preferably after having first mounted a washer 51. The washer 51 bears against the adjacent side wall 24 and is held in place by snap ring 46. Thus, axial movement of the fulcrum pin is prevented.

Preferably, the fulcrum pin, also, will be fixed against movement around its axis. To this end, the apertures in side walls 24, 26 are of larger cross-section than are the apertures in the speced arms 36 and 38 of handle 18. Further, the apertures are noncircular in outline. The fulcrum pin carries a boss 47 of like shape adjacent the flattened head 42 which boss 47 cooperates in the aperture in side wall 26 to prevent rotation of the pin 43. A bearing 44 is received within the similarly shaped aperture in side wall 24. The bearing includes a central opening for shank portion 43 and provides the surface against which at least a portion of the washer cooperates. Preferably, the apertures in side walls 24, 26 are formed within an area 49 which is recessed slightly. In this manner, both the flattened head of fulcrum pin 42 and the extending portion of the shank 43 including the snap ring 46 will be disposed substantially within the area of the recesses which are bounded by an annular ridge 48 in each side wall 24 and 26 (only one area 49 and ridge 48 is shown). Rotation of the fulcrum pin 42 is prevented by receipt of the boss 47 in the like shaped, non-circular aperture in side wall 26.

The chuck 30 may be seen to best advantage in FIG. 5. The chuck is received within and movable along the axis of the housing 16 through pivotal movement of the movable handle 18. The chuck may be formed alternatively as a one-piece or two-piece member, the latter including an upper case and a lower case which is threaded or otherwise received by the upper case for securement of a machine screw.

In a preferred form, the chuck is of two-piece construction including an upper case 50. The upper case is elongated and provides a central cylindrical neck portion 54 bounded by a pair of collars 56 and 58, the latter collar having an annular flange 60 whose outer diameter is substantially that of the diameter of collar 56. An extension 62 extends axially from the collar 58 and is threaded externally throughout its length. The chuck also includes a lower case 52 which is formed with an internal thread for receipt on the extension 62. The lower case provides an opening at its chamferred nose end through which the shank of a conventional hexagonal headed screw 66 extends. The opening is cylindrical in outline and of a cross-section to support the shank yet accommodate rotation as will be discussed. A pair of flats 68 for gripping the lower case during mounting on the upper case are disposed on opposed sides of the lower case. The flats may be loacted at the nose end.

As may be seen in FIGS. 2, 3, and 4 the inner surface axially of the opening in the lower case is recessed at 61 to receive the head of screw 66. The recess is of an outline like that of the head of the screw and of only slightly larger dimension to receive yet prevent rotation of the screw. The screw is supported axially between the lower case 52 and the end of the extension 62 of the upper case 50.

In an alternative embodiment, see FIG. 5*a*, the upper case 50′ includes an extension 62′ having a slot 64 at the end. The slot provides a pair of parallel flat walls which are spaced apart by a distance sufficient to receive snugly the head of the screw 66. In this alternative embodiment, the screw, similarly, is supported axially between the lower case 52′ and the upper case 50′. In this embodiment, the lower case provides a flat surface around the opening to support the lower surface of the head of screw 66.

As illustrated, the outer diameter of the lower case is substantially equal to that of the collar 58 thereby to provide a smooth surface toward the nose of the lower case.

In a further alternative embodiment, see FIG. 5*b*, the chuck is of one-piece construction. In this connection, the collar 58′ of upper case 50″ is extended to the length substantially of collar 58 and threaded extension 62′ (FIG. 5*a*) and formed with a slot 64′ which opens into an enlarged area for snug receipt of the head of screw 66.

An extension 70 extends upwardly of collar 56. The extension may be parallelepipedonal in outline and, as desired, may include an end slot 72 as well as a throughbore 74, all for purposes of screwing the chuck 20 into the workpiece W.

In operation, the chuck 20 first is received in the housing 16 through an opening formed by the side walls 24, 26, end wall 34 and a cross member 76 between the side walls. The cross member is substantially of pie-shaped outline toward the bottom wall 28 and together with the inner surface of end wall 34 is arcuately shaped around an axis extended upwardly from the housing 16. The end wall 34 and cross member 76 support the collar 56 while the inner surfaces of housing 16 support the collar 58.

The movable handle 18 is received by body 12 in a manner that the arms 36 and 38 are disposed on opposite sides of the cylindrical neck portion 54 between the collars 56 and 58. The movable handle then is secured to the body 12 and through the couple with the chuck upon pivotal movement of the handle imparts movement to the chuck.

The anvil includes a base 78 having an enlarged surface for supporting the anvil against the workpiece. A collar 80 is supported on the base and extends from the central portion thereof. The base is formed with an opening 82 along the axis of the collar and a boss 84 is disposed around and outwardly of the opening. The collar may be soldered or otherwise permanently secured to the base.

As illustrated, the base of the anvil is formed by a flat plate. The base, likewise, may be convex toward or concave away from the workpiece and may be of any particular overall outline, such as rectangular. See FIGS. 7 and 8 in which the anvils are identified by the numerals 22' and 22", respectively. Each base is formed with at least one and preferably two or more slots 86 situated around the collar 80. And a thumb screw 88 may be threaded through each collar 80 to bear against the nose portion of housing 16 to secure the housing on the anvil.

In operation, the housing is received by the anvil and the screw 66 is threaded into a hole (see FIG. 1) which preferably previously is drilled through the workpiece within the area of the dent. Threading movement may be imparted to the screw by means of an open end wrench 90 or, for example, by means of a pin or screwdriver which cooperate with the through hole 74 or slot 72, respectively. Upon threaded advance of the screw 66 the chuck 20 moves to the lower limit position of FIG. 2. At such position, the flange 60 of the upper case and the nose of the lower case 52 abut against a pair of shoulders internally of housing 16.

As should be apparent the shank of screw 66 necessarily will be of a length sufficient to be threaded to a suitable depth in the hole in the dent so as not to disengage during a pulling operation.

As the chuck is advanced to the limit position, the movable handle 18 is caused to pivot about the fulcrum pin 42. Pivotal movement is imparted to movable handle 18 by interaction of the rounded surfaces **36*a* and 38*a* and a shoulder of collar 56. The movable handle 18 and chuck 20 likewise cooperate in movement of the latter to a second limit position (see FIG. 3). In this movement the area of the dent surrounding the drilled hole is drawn toward the base 78 of anvil 22. By virtue of the boss 84 on the base of the anvil the area of the workpiece which is pulled will be prevented from moving into a position flush with the undented area of the workpiece. Therefore, an epoxy or other suitably body filling material may be employed to fill the depression prior to the final finishing operations, such as sanding and painting. One or more pulling operations may be required if the dent in the workpiece is severe both in depth and surface area. The slots 86 in the base of anvil 22 permit viewing of the area of the workpiece which is being pulled to assure that the constant and gradual pulling operation is progressing properly. Pulling of the dent is accomplished by the leverage on the handles 14 and 18, the latter of which moves to the second limit position whereat the movable handle is supported by the bottom wall 28 and the rounded surface 36*a* and 38*a* extend beneath the cross member 76,** as shown.

The structure described above, as should be apparent, will be formed of a material suitable to carry out the intended operation. Thus, and without intent of limitation to the scope of the invention, the anvil structure may be formed of steel. The chuck likewise may be formed of steel and suitably heat treated. The body and movable handle may be formed of an aluminum casting. Any of the structures may be plated, if desired.

While the invention has been described in connection with a preferred embodiment, it is not intended to limit the invention to the particular form set forth, but, on the contrary, it is intended to cover such alternatives, modifications, and equivalents as may be included within the spirit and scope of the invention as defined by the appended claims.

Having described the invention, what is claimed is:

1. Apparatus for use in drawing sheet metal within a dented surface comprising a plate adapted to be received on said sheet metal to span at least a portion of the area of said dented surface, said plate having an opening therethrough, a sleeve mounted on one side of said plate to surround said opening; a metal leveler, said metal leveler including a body having a handle and a housing offset at one end, said housing providing a chamber of substantially cylindrical cross-section between an opening at each end, said housing received in said sleeve with one end opening in longitudinal alignment with said plate opening, a chuck removably received in said chamber and movable longitudinally between two spaced limit positions, a screw having an elongated threaded shank, means for fixedly mounting said screw on said chuck with the threaded shank portion extending longitudinally of said housing through said one end opening, a second handle, means for mounting said second handle on said body for pivotal movement relative to said body handle, means for coupling said second handle and chuck whereupon longitudinal advance of said chuck toward the limit position near said one end opening causes said second handle to pivot in one direction and whereupon pivotal movement of said second handle in the opposite direction causes said chuck to retract longitudinally toward the other limit position nearer the other end opening, and means carried by said chuck for advancing said chuck toward said open end opening so that said screw threadedly engages through said sheet metal in said dent; and means to removably secure said housing in said sleeve.

2. The apparatus of claim 1 wherein said plate is formed with at least one slot adjacent said sleeve for viewing the dented surface of said sheet metal from one side of said plate.

3. The apparatus of claim 2 including an annular boss, said boss carried by said plate on the other side and disposed around said opening to prevent the sheet material in said dent from moving to a disposition flush with the sheet material adjacent said dent.

4. The apparatus of claim 3 wherein said plate is flat.

5. The apparatus of claim 3 wherein said plate is outwardly convex at said opening.

6. The apparatus of claim 3 wherein said plate is inwardly concave at said opening.

7. An anvil member for use with a metal leveler comprising a plate having a surface to be received on a sheet metal workpiece to span an area of a dent therein, said plate having a centrally located opening, a sleeve supported on the other surface of said plate around said opening, said sleeve being adapted to receive said metal leveler for pulling the sheet metal within said dent toward said first mentioned surface, an annular boss on said first mentioned surface surrounding said opening to limit movement of the sheet within said dent, and at least one slot in said plate surrounding said sleeve to permit a view of the sheet metal within said dent.

8. A metal leveler comprising, in combination, a body including a handle and an offset housing, said housing providing a chamber of substantially cylindrical cross section therethrough, a chuck having at least a portion thereof removably received in said chamber, said chuck being movable longitudinally relative to said chamber between two spaced limit positions, an element having an elongated threaded shank portion, means for fixedly mounting said element on said chuck with the axis of said threaded portion extending longitudinally of and in alignment with the axis of said housing, a second handle, means for mounting said second handle on said body for pivotal movement relative to said body handle, means for coupling said second handle and said chuck in such a manner that upon longitudinal advance of said chuck toward the first of said limit positions said second handle is pivoted in one direction and upon pivotal movement of said second handle in the opposite direction said chuck retracts longitudinally toward the other limit position, means carried by said chuck for advancing said chuck toward said first limit position, an anvil element removably mounted to said body, said anvil having a substantial lateral extent to bear against a work piece during said pivotal movement of said second handle in said opposite direction, an opening through said anvil through which said threaded shank extends, and means providing for viewing said work piece through said anvil.

9. The device of claim 8 in which the surface of said anvil which faces the work piece during operation has an annular boss positioned around said opening to prevent the metal of the work piece from moving to a completely flush position.

10. The device of claim 9 in which said anvil is removably secured to said body by means of a sleeve mounted coaxially with the opening in said anvil on the side of said anvil opposite to said boss, and means for readily engaging and disengaging said offset housing within said sleeve.

* * * * *

UNITED STATES PATENT AND TRADEMARK OFFICE

CERTIFICATE OF CORRECTION

PATENT NO. : 4,037,448

DATED : July 26, 1977

INVENTOR(S) : ANTHONY E. DI MAIO et al

It is certified that error appears in the above-identified patent and that said Letters Patent are hereby corrected as shown below:

The title page should indicate that this patent claims priority of British Application Serial No. 9874/75 filed March 10, 1975.

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*